US005199905A

United States Patent [19]

Fillinger

[11] Patent Number: 5,199,905

[45] Date of Patent: Apr. 6, 1993

[54] LAY-IN PEDESTAL CONNECTOR BAR AND METHOD

[75] Inventor: David R. Fillinger, Cincinnati, Ohio

[73] Assignee: Connector Manufacturing Co., Hamilton, Ohio

[21] Appl. No.: 848,673

[22] Filed: Mar. 9, 1992

[51] Int. Cl.[5] ..... H01R 11/09
[52] U.S. Cl. ..... 439/723; 439/798
[58] Field of Search ..... 439/720, 721, 796–798, 439/724, 723

[56] References Cited

U.S. PATENT DOCUMENTS

| | | | |
|---|---|---|---|
| 2,748,365 | 5/1956 | Speck | 439/723 |
| 3,171,708 | 3/1965 | Salomone | 439/798 |
| 3,426,319 | 2/1969 | Downs et al. | 439/798 |

OTHER PUBLICATIONS

Connector Manufacturing Company Type NA Secondary Connector for above grade use Fall 1990 p. B–6.
Connector Manufacturing Company Type LI/CL Lay-In Ground Connector Fall 1990, p. E–4.
Connector Manufacturing Company Type HL Hot Line Connector Fall 1990, p. C–2.
Utilco Mid Span Overhead Taps, Types ULP, MST and TNT.
Utilico Type PED-RH Pedestal Connector.

*Primary Examiner*—Larry I. Schwartz
*Assistant Examiner*—Hien D. Vu
*Attorney, Agent, or Firm*—Biebel & French

[57] ABSTRACT

A connector bar for use in above grade pedestals for the distribution for underground electrical power to residential housing includes a body member having a pair of completely enclosed cable openings for receiving the main power line cables and partially enclosed wire openings within the body member for receiving distribution cables. Each distribution cable is trimmed to the proper length by placing it adjacent the connector bar and cutting the connector approximately flush with the top of the bar and the insulation is trimmed from the cable at a location just below the connector bar. After these steps have been accomplished, the cable is installed into the connector bar by laterally placing it into the partially enclosed opening and securing it in place by means of the set screw.

4 Claims, 3 Drawing Sheets

LAY-IN PEDESTAL CONNECTOR BAR AND METHOD

BACKGROUND OF THE INVENTION

This invention relates to an improved pedestal connector bar for use in above grade pedestals of the type used by electric utilities for the distribution of underground electrical power to residential housing.

Above grade power distribution pedestal boxes are typically installed at intervals along a utility easement in new residential communities. The main power cables are run from one pedestal box to another, with the power cables terminating in connector bars located in each box. Prior art connector bars are often rectangular blocks of metal having two opening for the main power line conductors or cable, and one to six or more additional openings for distribution cables to residences or to other utilities. Set screws are provided to secure the conductors mechanically and electrically in the connector bar. Each pedestal box contains three connector blocks since a three-wire residential distribution system is commonly used.

Both the main power carrying cable and the runs to each residence enter the distribution box vertically from under the ground. These cables are approximately ¾ inch in diameter and are therefore stiff and difficult to bend and maneuver once in the box. Initially, each connector bar is supported by the two main power cables, but as the utility company adds services, a new set of distribution cables will be attached to the connector bar. This operation is typically one of the last procedures performed in new home construction since it will be done only after the electric meter on the home has been installed.

To make the connection to the connector bar, the distribution cables are fed vertically upwardly into the pedestal box, cut to the proper length, trimmed of their insulation and inserted into the connector bar. If the cable is cut too short, the entire pedestal connection must be re-done; if it is too long, then the cable must be recut. Even if properly cut to length, it is difficult to install a cable wire because of the space limitation in the box and the stiffness of the cable.

A need therefore exists in this field for a better connector bar and a method for installing new services from existing pedestal distribution boxes.

SUMMARY OF THE INVENTION

The present invention relates to a new and improved connector bar for use in above grade pedestal electrical power distribution boxes, and to a method of installing power distribution wires or cables to the connector bar.

The connector bar of the present invention includes a body member having a pair of completely enclosed cable openings for receiving the main power line cables. Instead of providing completely closed openings for the distribution cables, however, the present invention includes two or more partially enclosed wire openings within the body member, and set screws for securing the cables placed in these openings.

The distribution cable may be trimmed to the proper length by placing it adjacent the connector bar and cutting the connector approximately flush with the top of the bar. Similarly, the insulation may be trimmed from the cable at a location just below the connector bar. After these steps have been accomplished, the cable or wire is installed into the connector bar by laterally placing it into one of the partially enclosed openings and securing it in place by means of the set screw.

Accordingly, it is an object of this invention to provide a lay-in pedestal connector bar comprising a body member formed from a generally rectangular volume of metal, said body member including a front surface, a top surface and right and left sides, means forming a pair of generally centrally located, completely enclosed wire openings in said top surface, said openings extending completely through said body member for receiving power supply cables, means forming at least two lay-in openings in said top surface on each side of said body member, each of said openings extending completely through said body member and including entry slots for receiving distribution cables, and set screws extending through said front surface of said body member into said enclosed openings and said lay-in openings for securing electrical cables placed in said openings.

It is a further object of this invention to provide a pedestal connector bar comprising an elongated body member, at least one completely enclosed opening formed in the central portion of said body member for receiving the end of an electrical cable, at least two partially enclosed openings formed in said body member for receiving electrical cables that may be laterally placed into said opening, and set screws in said body member associated with each of said openings for securing a wire inserted thereinto in electrical and mechanical contact with said body member.

It is still another object of this invention to provide a method of installing connectors in a pedestal box including the steps of inserting a first pair of electrical cables end first into a corresponding pair of enclosed openings in a connector bar and securing said cables to the bar, and installing additional electrical cables into the connector bar by laterally placing the cables into partially enclosed openings formed in the connector bar and mechanically and electrically securing said cables to the connector bar.

It is a further object of this invention to provide a method of installing electrical cables in a connector bar of the type describe including the steps of placing a cable to be installed adjacent the connector bar, cutting the cable approximately flush with the upper surface of the connector bar, trimming the insulation on the cable below the lower surface of the connector bar, laterally placing the cable into a partially enclosed opening in the connector bar, and securing the cable to the bar.

Other objects and advantages of the invention will be apparent from the following description, the accompanying drawings and the appended claims.

DESCRIPTION OF THE PREFERRED EMBODIMENT

Figure 1:
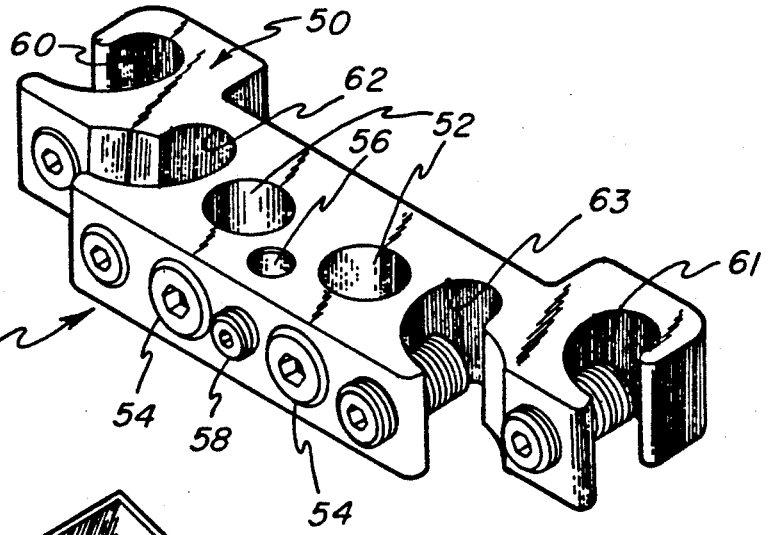
FIG. 1 is a perspective view of a lay-in pedestal connector bar constructed according to this invention.
Figure 2:
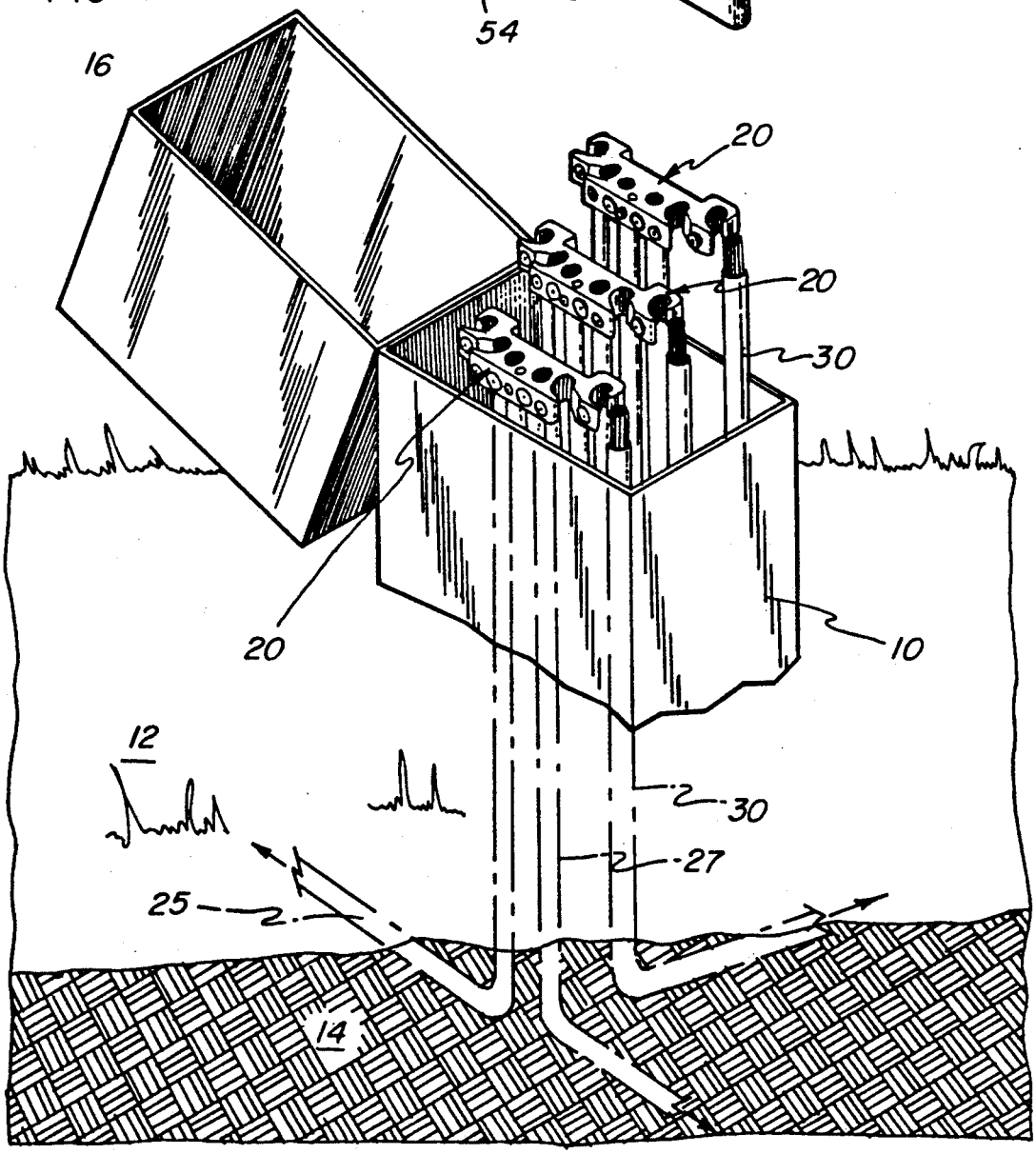
FIG. 2 is a perspective view showing an above-grade pedestal box showing three lay-in pedestal connector bars and the electrical cables connected thereto.

Referring now to the drawings, which illustrate a preferred embodiment of the invention, a pedestal box 10 is shown in FIG. 2. Box 10 is mounted above the surface 12 of the ground 14 and normally contains three connector bars 20. The box may be provided with a hinged cover 16 and a locking mechanism (not shown) to prevent unauthorized entry. The connector bars 20 are normally situated in the box at different levels to facilitate access to the set screws which hold the cables in place.

In FIG. 2, a single power cable 25 is shown entering the box 10 vertically from beneath the ground, and is attached to the connector bar 20. A continuing power cable 27 is shown descending vertically into the ground 14 and then extending horizontally beneath the surface toward another pedestal box. A service distribution cable 30 is shown, also extending downwardly from the connector bar 20 and then extending horizontally toward the lower right. While only one set of main power cables 25, 27 is shown for purposes of clarity, it is to be understood that there will be three sets of main power cable in a typical installation. Likewise, there will be at least one and usually several, distribution cables extending from each connector bar 20 in the pedestal box 10.

Figure 3:
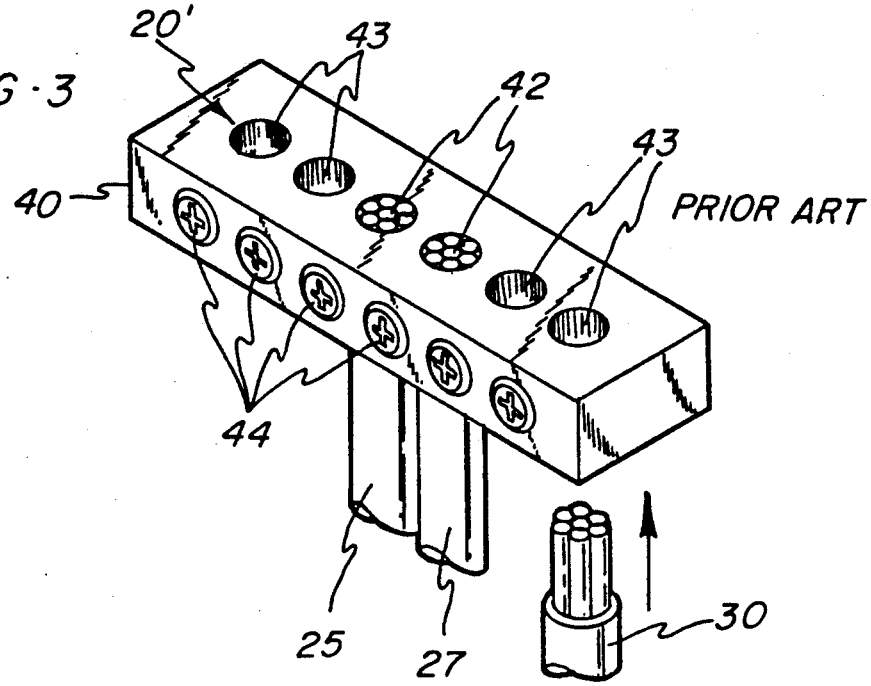
FIG. 3 is a perspective view showing a method of connecting electrical cable to a prior art pedestal connector bar.

A prior art connector bar 20' is shown in FIG. 3. This bar includes a rectangular block or main body member 40 into which is formed several enclosed openings 42 and 43. The openings 42, 43 are slightly larger in diameter than the cables 25, 27 and 30, after the cables have been stripped of their insulation. The two main power cables 25, 27 are normally placed in the center-most openings 42 and are held by set screws 44. This is normally done for all three of the connector bars, prior to any of the distribution cables 30 being installed.

When it is desired to connect a distribution cable 30 to the connector bar 20', the distribution cable is fed vertically upwardly into the pedestal box, cut to the proper length, trimmed of its insulation and inserted into one of the other openings 43 in the connector bar. As shown in FIG. 3, the distribution cable 30 must be maneuvered to a position below an opening 43 in the connector bar 20' and then moved upwardly into place, a somewhat difficult operation considering the limited space available and the stiffness of the cable.

In the present invention, as illustrated in FIGS. 1 and 4–6, the connector bar 20 is formed from a generally rectangular 14 body member or metal block 50 and includes a pair of completely closed wire openings 52 located at the center of the block for receiving the main power cables 25, 27. In a preferred embodiment, the block 50 is formed from extruded aluminum and is 7.482 inches long, 2.830 inches wide and 1.125 inches thick. The openings 52 may be designed to receive cables of as large as 500 mcm. A pair of set screws 54 are provided to hold the cables 25, 27 in place. At the center of the block 50 is a smaller opening 56 for receiving a wire that may be connected to a street lamp. A set screw 58 secures that wire.

Figure 5:
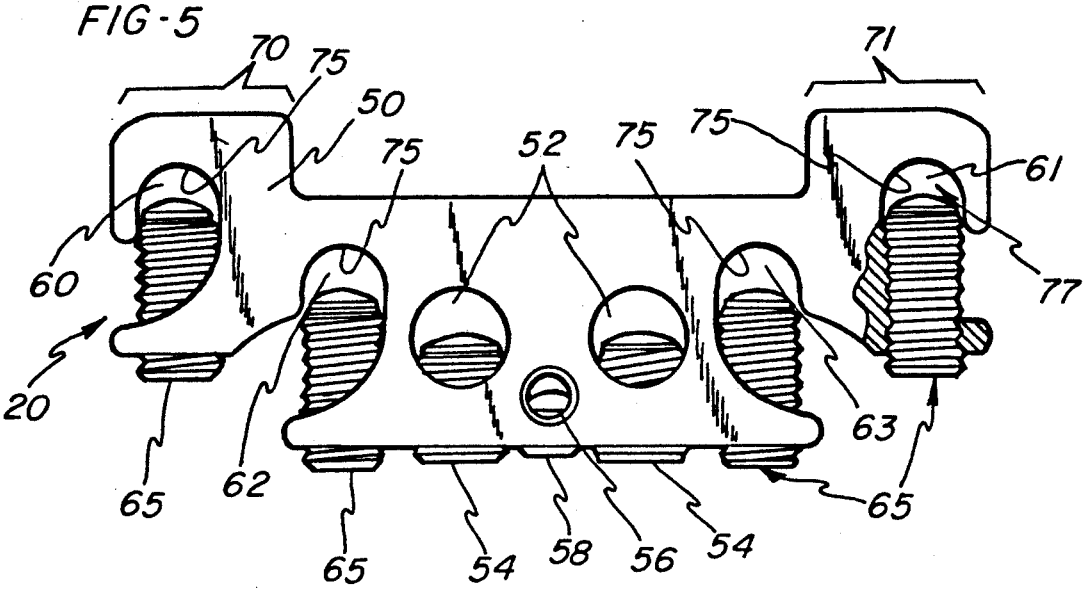
FIG. 5 is a plan view, partly in Cross Section, of a lay-in pedestal connector bar constructed according to this invention.
Figure 6:
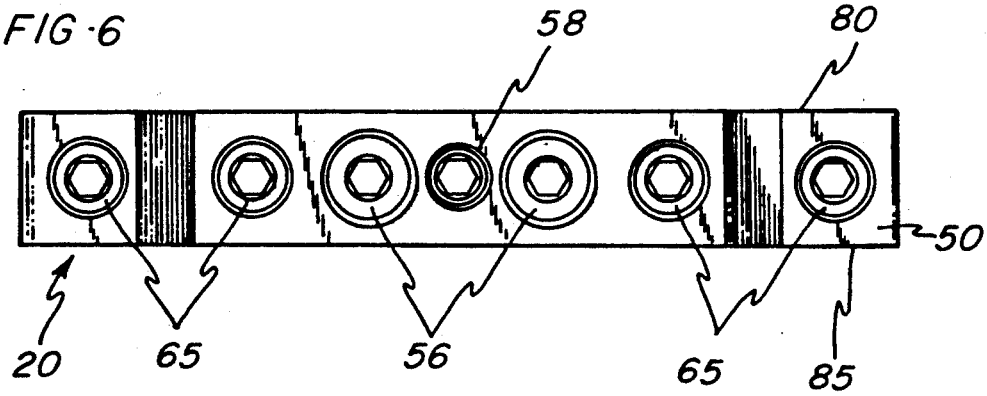
FIG. 6 is a front elevational view of FIG. 5.

As shown clearly in FIG. 5, there are four lay-in openings or ports 60–63 for receiving distribution cables 30. Set screws 65 are associated with each opening to hold these cables in place. Each of the set screws 54, 58 and 65 are provided with an opening for receiving an tightening tool, such as an Allen wrench. The block 50 is formed with two offset regions designated as 70 and 71 in FIG. 5, in which the outside lay-in openings 60 and 61 are formed. These offset regions facilitate the unrestricted access of a cable 30 into the inside lay-in openings 62 and 63.

Each of the lay-in openings 60–63 includes a semi-circular portion 75 (FIG. 5) and an entry channel 77. Thus, when the respective set screw 65 is withdrawn, a distribution cable 30 may be inserted merely by moving the cable laterally into the opening, and then it is held securely in place by the set screw 65.

Figure 4:
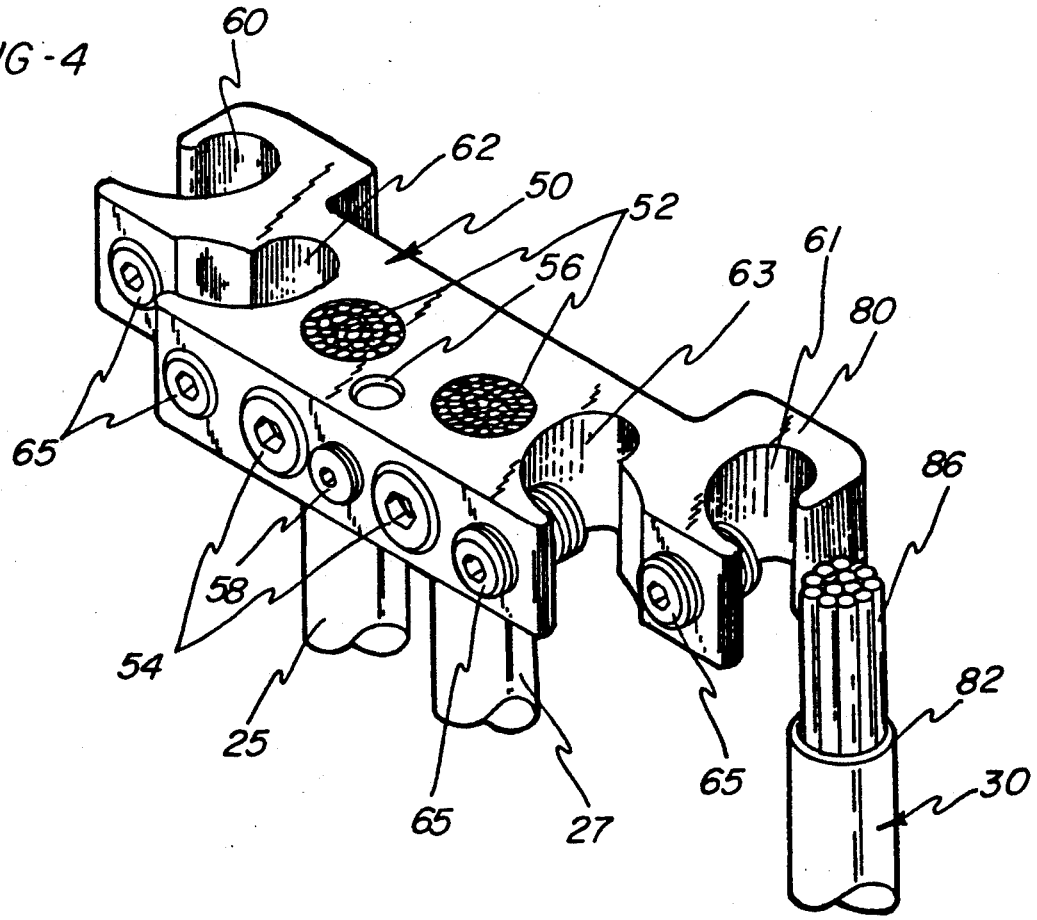
FIG. 4 is a perspective view showing a method of connecting electrical cables to a lay-in pedestal connector bar of this invention.

In practice, the distribution cable will be brought to a position adjacent the connector bar 20, as shown in FIG. 4, and the cable will be cut approximately flush with the top surface 80 of the bar. The insulation 82 surrounding the cable will be trimmed to just below the lower surface 85 of the connector bar, exposing the bare copper or aluminum wire 86 of the cable. Next, the cable 30 is installed by laterally moving the cable into the entry channel 77 and then into the circular portion 75 of the lay-in opening 61 with the bare metal 86 of the cable 30 in direct contact with the metal surface of the connector bar 20. Finally, the set screw 65 is tightened to secure the cable mechanically and electrically. This operation is clearly more convenient than prior art methods since the cable 30 does not have to be moved vertically at any time in order to install it in the connector bar.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claim.

What is claimed is:

1. A lay-in pedestal connector bar comprising a body member formed from a generally rectangular volume of metal, said body member including a front surface, a top surface and right and left sides, means forming a pair of generally centrally located, completely enclosed wire openings in said top surface, said openings extending completely through said body member for receiving power supply cables, means forming at least two lay-in openings in said top surface, one set of lay-in openings on each of the left and right sides of said body member, each of said openings extending completely through said body member and including entry slots for receiving distribution cables, and set screws extending through said body member into said enclosed openings and said lay-in openings for securing electrical cables placed in said openings.

2. A pedestal connector bar comprising an elongated body member, at least one completely enclosed opening formed in the central portion of said body member for longitudinally receiving the end of an electrical cable, at least two partially enclosed openings formed in said body member, at least one partially enclosed opening placed on each of opposite side of said completely enclosed opening, for receiving electrical cables that may be laterally placed thereinto, and set screws in said body member associated with each of said completely enclosed and said partially enclosed openings for securing a wire inserted thereinto in electrical and mechanical contact with said body member.

3. The pedestal connector bar of claim 2 wherein said partially enclosed openings comprise at least one half circle.

4. A method of installing connectors in a pedestal box including the steps of longitudinal inserting at least one electrical cable end into an enclosed opening in a connector bar and securing said cable to the bar, temporarily placing an additional cable adjacent the connector bar, cutting the cable approximately flush with the upper surface of the connector bar, trimming the insulation from the cable below the lower surface of the connector bar, and installing additional electrical cables onto the connector bar by laterally placing the cables into partially enclosed openings formed in the connector bar and set screws mechanically and electrically securing said cables to the connector bar.

* * * * *